United States Patent [19]

Randall, III et al.

[11] Patent Number: 4,654,247

[45] Date of Patent: Mar. 31, 1987

[54] METHOD FOR IMPROVING THE TUFT BIND OF TEXTILE COVERINGS

[75] Inventors: Osro W. Randall, III; John M. Kernstock, both of Midland, Mich.; Nicholas S. Hanlon, Cohulta, Ga.; Stephen H. Erickson, Midland, Mich.

[73] Assignee: The Dow Chemical Company, Midland, Mich.

[21] Appl. No.: 806,586

[22] Filed: Dec. 9, 1985

[51] Int. Cl.[4] ..... B32B 3/00

[52] U.S. Cl. ..... 428/95; 427/322; 427/412; 428/96; 428/97

[58] Field of Search ..... 428/96, 95, 97; 427/322, 412

[56] References Cited

U.S. PATENT DOCUMENTS 4,246,309 1/1981 Daniel ..... 428/96

4,439,474 3/1984 Sagel ..... 428/96

*Primary Examiner*—Marion C. McCamish

[57] ABSTRACT

The present invention is directed toward a method for improving the tuft bind of yarn in textile coverings. The method comprises applying to the yarn, prior to applying an adhesive, a functional amount of an aqueous dispersion comprising a surfactant and/or polymeric component wherein the aqueous dispersion has a surface tension approximately equal to or less than the surface tension of the yarn. The present invention also is directed toward a textile covering having improved tuft bind prepared by the aforementioned method. The method is advantageously employed in the preparation of floor coverings to maintain the original appearance and resist the loss of pile or a condition known as pill and fuzzing.

16 Claims, No Drawings

METHOD FOR IMPROVING THE TUFT BIND OF TEXTILE COVERINGS

BACKGROUND OF THE INVENTION

The present invention is directed toward a method for improving the penetration of latex adhesives into yarn present in the backing of a textile covering such that the tuft bind of the yarn is improved. Tuft bind is the force required to remove the yarn or single filament thereof from a backing material.

The satisfactory performance of a textile covering, such as a floor covering, depends to a considerable extent on the maintenance of the original appearance of the textile covering. In a tufted, knitted or woven pile textile covering, an inadequate tuft bind may result in complete loss of the pile in the areas exposed to severe wear or a condition known as pill and fuzzing. Pill and fuzzing are the result of the individual filaments of a yarn being gradully displaced from the yarn. In more severe cases a tufted, knitted or woven pile textile covering with inadequate tuft bind may have the individual yarns pulled out to form unsightly long tufts or occassionally develop hazardous loops. It is therefore very desirable to improve the tuft bind of the individual yarns in the backings of the textile coverings.

More recently, new and improved yarns have been developed for use in the carpet industry and/or pile floor covering industry which are specifically designed to be soil resistant, static resistant, mold and mildew resistant and stain resistant. Whereas, the improved yarns are advantageous over the old yarns, they do present manufacturing problems. In particular, the yarns, while being resistant to the passage of foreign materials, are also therefore resistant to the latex adhesive necessary to firmly bind it to the backing of the textile covering. Thus, the new yarns resist the penetration of latex adhesives which therefore results in poor tuft bind. Accordingly, the appearance of the tufted, knitted or woven textile covering made with the newer yarns are very susceptible to loss of pile in areas exposed to severe wear and pill and fuzzing. It is therefore desirable to develop a method for improving the tuft bind of not only conventional yarns but the new yarns which are resistant to the passage of foreign materials.

SUMMARY OF THE INVENTION

In one aspect, the present invention is a method for improving penetration of an adhesive into yarn present on the backing of a textile covering. The method is characterized by applying to the yarn, prior to applying an adhesive, a functional amount of an aqueous dispersion having a surfactant and/or a polymeric component. The aqueous dispersion has a surface tension approximately equal to or less than the surface tension of the yarn.

Where the aqueous dispersion contains a polymeric component or polymeric and surfactant components, they are generally present in amounts up to about 50 percent, more preferably 10 to about 30 percent by total weight of the aqueous dispersion. Where the aqueous dispersion contains only a surfactant, it is generally present in an amount of from about 0.02 to about 2 percent, more preferably 0.05 to about 0.5 percent by total weight of the aqueous dispersion. Preferred surfactants are fluorocarbon surfactants.

An aqueous dispersion containing a polymeric component or polymeric and surfactant component is generally applied to the backing in an amount of from about 0.25 to about 25 oz/yd$^2$, more preferably 1 to about 5 oz/yd$^2$ on a dry basis. An aqueous dispersion containing only a surfactant component is applied to the backing in an amount of from about 0.001 to about 2 oz/yd$^2$, preferably 0.005 to about 0.5 oz/yd$^2$ on a dry basis. The preferred method of applying the aqueous dispersion is by a spray application means.

In another aspect, the present invention is directed toward a textile covering having improved tuft bind prepared by applying to the yarn present on the backing of a textile covering an aqueous dispersion comprising a surfactant and/or a polymeric component prior to the application of an adhesive. The aqueous dispersion has a surface tension approximately equal to or less than the surface tension of the yarn employed in the preparation of the textile covering whereby the penetration of the adhesive into the yarn is improved. The yarn which makes up the textile covering can be any of a variety of synthetic and natural yarns such as nylon, polypropylene, acrylic, polyester, cotton or wool.

Textile coverings prepared by the present invention are resistant to having the yarns pulled from the backing and are resistant to a condition known as pill and fuzzing. Thus, the present invention provides an improved method for preparing a textile covering having increased durability and resistance to severe wear. The present invention is especially adaptable for use in the manufacture of tufted floor coverings.

DETAILED DESCRIPTION OF THE INVENTION

The present invention provides for an improvement in the tuft bind of tufted, knitted or woven textile coverings (hereinafter jointly referred to as "tufted"). Generally, the method for improving tuft bind involves the application of an aqueous dispersion containing a surfactant and/or polymeric component to the textile backing prior to applying the adhesive material. The aqueous dispersion is formulated such that it facilitates the flow or uptake of the subsequently applied adhesive material into the yarn or tuft. The ability of the subject aqueous dispersion to assist in the transfer of adhesive to fabric filaments or yarns is especially of value where the primary backing is not a smooth surface but rather a rough texture or undulated surface.

Tuft is defined as the cut or uncut loops of yarn formed from fabric filaments which thus form the textile surface. The fabric filaments or yarn are woven, needle punched, stitched or otherwise mechanically affixed to a primary backing. It is to the underside of this primary backing that the application of the aqueous dispersion is made. The subject aqueous dispersion has an affinity for the particular fabric filaments employed which serve to allow the subsequently applied adhesive material to be taken up by or penetrate the individual filaments of the yarn.

The characteristic of transporting the adhesive material up to or into the filament greatly enhances their adhesion to the filaments and yarns to themselves and to the primary backing and respectively to the secondary backings. Typically, the secondary backings are coarse, textile fabric laminated to the primary backing to reinforce the latter. The aqueous dispersion which is applied to the primary backing is specially formulated to have a surface tension approximating or less than that of the yarn. Generally, the aqueous dispersion is formulated by adding a functionally effective amount of a surfactant and/or polymeric material which is compatible with the adhesive coating to be applied and which itself has a surface tension approximating or less than that of the yarn.

Typically, when a polymeric component or both a polymeric and a surfactant component are employed in the aqueous dispersion, they are present in an amount of up to about 50 percent, preferably 10 to 30 percent by total weight of the aqueous dispersion. When only a surfactant component is employed, it is generally present in an amount of from about 0.02 to about 2.0 percent, preferably from about 0.05 to about 0.5 percent by total weight of the aqueous dispersion.

An important aspect in the preparation of the aqueous dispersion is that the surfactant or polymeric component employed has a surface tension approximately equal to or less than the yarn to be treated. For example, fluorocarbon surfactants having a low surface tension of from about 12 to about 30 dynes are very good choices because their surface tension is generally lower than most yarns commonly employed in the manufacture of textile coverings.

Other surfactants having similarly low surface energy can also be employed. Surface energy values are generally available from references such as Skeist, *Handbook of Adhesives,* chapter 3 (2nd Ed. 1977); Shafrin, *Polymer Handbook,* "Critical Surface Tensions of Polymers" (2nd Ed. 1975); *ACS, Chemistry and Physics of Interfaces,* (1965).

In addition to the surfactant, a polymeric component, for example a latex compatible with the latex adhesive to be subsequently applied, can be incorporated into the aqueous dispersion. This can improve the uptake of substantially applied adhesive into the yarn's filaments. Thus, the practitioner of the present invention will choose a surfactant and/or polymeric component having a surface tension approximately equal to the yarn to be employed in the preparation of the textile covering. The surfactant and/or polymeric component is then admixed into water to form an aqueous dispersion in an amount as defined above.

After the aqueous dispersion is prepared, it is applied to the backing of the textile material in a functionally effective amount such that the penetration of the subsequently applied adhesive is improved. Generally, an aqueous dispersion having a polymeric or both a polymeric and surfactant component is applied to the backing in an amount from about 0.25 to about 25 oz/yd$^2$ on a dry basis, preferably from about 1 to about 5 oz/yd$^2$ on a dry basis. Typically, an aqueous dispersion having only a surfactant component is applied to the backing in an amount from about 0.001 to about 2 oz/yd$^2$ on a dry basis, more preferably in an amount of from about 0.005 to about 0.5 oz/yd$^2$ on a dry basis.

The aqueous dispersion can be applied to the backing of the textile covering by any convenient method such that the yarns are wetted. Typical methods may include brush, roller, or more preferably a spray. Generally, the application is performed as close to the application of the adhesive as is possible or such that the aqueous dispersion is not completely lost via evaporation prior to the application of the adhesive.

The subject method for improving the penetration of a latex adhesive into the yarn present on the backing of a textile covering is especially adaptable for use in the preparation of quality pile floor coverings, especially when employing yarns treated to be resistant to foreign materials. Many varieties of synthetic and natural yarns can be treated by the subject aqueous dispersion for better tuft bind such as nylon, polypropylene, acrylic, polyester, wool or cotton.

EXAMPLE I

An aqueous dispersion was prepared having 0.1 percent by total weight of a fluorocarbon surfactant dispersed therein. The fluorocarbon surfactant had a surface tension value of 18.5 dynes/cm at a one percent concentration at 25° C. The aqueous dispersion also had a surface tension of approximately 18.5 dynes/cm.

The aqueous dispersion was applied to the backing of a tufted pile floor covering which was prepared from nylon yarn having a surface tension of about 40 to 44 dynes/cm. One-half of the floor covering material was untreated and one-half was treated with the subject aqueous dispersion. The aqueous dispersion was applied to the treated covering material at a rate of 0.008 oz/yd$^2$ on a dry basis. After applying the aqueous dispersion, a latex adhesive was blade coated onto the backing material and a secondary backing applied. The carpet section was then dried in an oven. After the carpet section was completely dried, a visual inspection showed no difference between the section of the carpet treated with the aqueous dispersion and the section that was not treated with the aqueous dispersion.

The section was then subjected to a tuft bind test which consisted of running a velcro brush over the surface of the carpet. After one pass of the velcro brush, the untreated section showed considerable pill and fuzzing; whereas, the treated section maintained its original appearance. This test demonstrates the improvement of tuft binding in the carpet section treated with the subject aqueous dispersion.

EXAMPLE II

An aqueous dispersion was prepared having both a polymeric and surfactant component dispersed therein. The polymeric component consisted of a latex of 35 parts vinylidene chloride, 36 parts butadiene and 27 parts styrene. The latex was added to the aqueous dispersion in an amount of 26 percent by total weight of said aqueous dispersion and had a surface energy value of about 40 dynes/cm. The amount of latex was calculated on the basis of dry parts. A surfactant component was also added to the aqueous dispersion in an amount of 0.2 percent by total weight of the aqueous dispersion. The surfactant was a fluorocarbon surfactant and had a surface tension value of approximately 18.5 dynes/cm at a 1 percent concentration at 25° C. The total surface tension of the aqueous dispersion was approximately 25 dynes/cm.

The aqueous dispersion was thoroughly mixed and was applied to the backing of a tufted pile floor covering which was prepared from nylon yarn having a surface tension of about 40 to 44 dynes/cm. One portion of the floor covering material was untreated and an adjacent portion was treated with the subject aqueous dispersion. The aqueous dispersion was applied at a rate of 2 oz/yd$^2$ on a dry basis. After the application of the aqueous dispersion, a latex adhesive was coated onto the backing material and a secondary backing applied. The carpet section was then dried in an oven. After the carpet section was completely dried, a visual inspection showed no difference between the section of carpet treated with the aqueous dispersion and the section that was not treated with the aqueous dispersion.

The tuft bind of the carpet sections was measured by employing the standard test method for tuft bind of pile floor coverings ASTM D-1335-67. The method consisted of measuring the force required to pull a cut loop from the carpet section. The required load or force is reported in pounds-force (lbf). For the untreated carpet section, a 5.0 lbf was required to pull a loop from the backing of the carpet. For the trated carpet section, a 7.1 lbf force was required to pull a loop from the carpet backing. This represents a 42 percent increase in tuft bind for the section of the carpet treated by the method of the subject invention versus the unntreated carpet section. Therefore, with all other parameters being held equal, the application of the present aqueous dispersion to the yarn present on the backing prior to the application of the latex adhesive had a significant effect upon the improvement of tuft bind.

What is claimed is:

1. A method for improving penetration of an adhesive into yarn present on an underside of a primary backing of a textile covering said method characterized by (a) applying to the yarn on the underside of the primary backing, prior to applying said adhesive, a functional amount of an aqueous dispersion comprising a surfactant and/or a polymeric component, wherein said aqueous dispersion has a surface tension approximately equal to or less than the surface tension of said yarn; and (b) applying to the yarn so treated on the underside of the primary backing an adhesive, whereby the penetration of such adhesive into the yarn is improved over the penetration obtained without the preapplication of the aqueous dispersion.

2. The method of claim 1 where said aqueous dispersion contains a polymeric component or polymeric and surfactant components in an amount of up to about 50 percent by total weight of said aqueous dispersion.

3. The method of claim 2 where said aqueous dispersion contains a polymeric component or polymeric and surfactant components in an amount of from about 10 to about 30 percent by total weight of said aqueous dispersion.

4. The method of claim 1 where said aqueous dispersion contains only a surfactant present in an amount of from about 0.02 to about 2.0 percent by total weight of said aqueous dispersion.

5. The method of claim 4 where said surfactant is present in an amount of from about 0.05 to about 0.5 percent by total weight of said aqueous dispersion.

6. The method of claim 1 where said surfactant is a fluorocarbon surfactant.

7. The method of claim 1 where said polymeric component is a latex polymeric component.

8. The method of claim 1 where said aqueous dispersion contains a polymeric component or polymeric and surfactant component and is applied to said backing in an amount of from about 0.25 to about 25 oz/yd$^2$ on a dry basis.

9. The method of claim 8 where said aqueous dispersion contains a polymeric component or polymeric and surfactant component and is applied to said backing in an amount of from about 1 to about 5 oz/yd$^2$ on a dry basis.

10. The method of claim 1 where said aqueous dispersion contains only a surfactant component and is applied to said backing in an amount of from about 0.001 to about 2 oz/yd$^2$ on a dry basis.

11. The method of claim 10 where said aqueous dispersion contains only a surfactant component and is applied to said backing in an amount of from about 0.005 to about 0.5 oz/yd$^2$ on a dry basis.

12. The method of claim 1 where said aqueous dispersion is applied by a spray application means.

13. A textile covering having improved tuft bind prepared by applying to a yarn present on an underside of a primary backing of said textile covering, prior to the application of an adhesive, an aqueous dispersion comprising a surfactant and/or a polymeric component, wherein said aqueous dispersion has a surface tension approximately equal to or less than the surface tension of said yarn employed in the preparation of said textile covering whereby penetration of said adhesive into said yarn is improved.

14. The textile covering of claim 13 where said surfactant is a fluorocarbon surfactant.

15. The textile covering of claim 13 where said yarn is nylon, polypropylene, acrylic, polyester, cotton or wool.

16. The textile covering of claim 15 where said yarns are pretreated to be resistant to foreign materials.

* * * * *